US006677064B1

(12) United States Patent
Subramanian

(10) Patent No.: US 6,677,064 B1
(45) Date of Patent: Jan. 13, 2004

(54) IN-SITU FORMATION OF MULTIPHASE DEPOSITED THERMAL BARRIER COATINGS

(75) Inventor: Ramesh Subramanian, Oviedo, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 10/157,569

(22) Filed: May 29, 2002

(51) Int. Cl.[7] ..... B32B 15/04; F03B 3/12

(52) U.S. Cl. ..... 428/702; 428/469; 428/472; 428/701; 428/697; 428/699; 428/937; 416/241 B

(58) Field of Search ..... 428/469, 471, 428/472, 472.2, 937, 701, 702, 697, 699; 416/241 B

(56) References Cited

U.S. PATENT DOCUMENTS

| | | | |
|---|---|---|---|
| 2,869,227 A | | 1/1959 | Bradstreet |
| 4,916,022 A | | 4/1990 | Solfest et al. |
| 5,238,752 A | | 8/1993 | Duderstadt et al. |
| 5,350,599 A | | 9/1994 | Rigney et al. |
| 5,562,998 A | | 10/1996 | Strangman |
| 5,573,862 A | | 11/1996 | Gualtieri et al. |
| 5,683,825 A | | 11/1997 | Bruce et al. |
| 5,716,720 A | | 2/1998 | Murphy |
| 5,721,057 A | | 2/1998 | Bamberg et al. |
| 5,763,107 A | | 6/1998 | Rickerby et al. |
| 5,780,110 A | | 7/1998 | Schaeffer et al. |
| 5,824,423 A | | 10/1998 | Maxwell et al. |
| 5,846,605 A | | 12/1998 | Rickerby et al. |
| 6,203,927 B1 | * | 3/2001 | Subramanian et al. |
| 6,294,260 B1 | | 9/2001 | Subramanian |
| 6,296,945 B1 | | 10/2001 | Subramanian |

FOREIGN PATENT DOCUMENTS

| | | |
|---|---|---|
| EP | 0389959 A1 | 3/1990 |
| EP | 0455451 A1 | 11/1991 |
| FR | 2163369 | 12/1971 |
| JP | 07025690 | 1/1995 |

* cited by examiner

*Primary Examiner*—Deborah Jones
*Assistant Examiner*—Jennifer McNeil

(57) ABSTRACT

A multiphase ceramic thermal barrier coating is provided. The coating is adapted for use in high temperature applications in excess of about 1200° C., for coating superalloy components of a combustion turbine engine. The coating comprises a ceramic single or two oxide base layer disposed on the substrate surface; and a ceramic oxide reaction product material disposed on the base layer, the reaction product comprising the reaction product of the base layer with a ceramic single or two oxide overlay layer.

14 Claims, 2 Drawing Sheets

IN-SITU FORMATION OF MULTIPHASE DEPOSITED THERMAL BARRIER COATINGS

GOVERNMENT RIGHTS STATEMENT

This invention was conceived under United States Department of Energy Contract DE-FC21-95MC32267. The United States Government has certain rights hereunder.

FIELD OF THE INVENTION

The present invention relates in general to the field of thermal barrier coatings and, in particular, to multiphase ceramic thermal barrier coatings used in high temperature applications for coating superalloy components of a combustion turbine engine.

BACKGROUND OF THE INVENTION

Many power generation plants produce electricity by converting potential energy (e.g. fossil fuel) into mechanical energy (e.g. rotation of a turbine shaft), and then converting the mechanical energy into electrical energy (e.g. by the principles of electromagnetic induction). These power generation plants typically use a turbine to convert the potential energy into mechanical energy and a generator to convert the mechanical energy into electricity.

One aspect of the above-described power generation scheme involves the use of increasingly higher combustion temperatures within the combustion portion of the turbine to improve the turbine efficiency of combustion turbine. Turbine components must therefore be capable of withstanding the increasingly higher temperatures from the combustion gas flow path for prolonged sustained periods of time, which can exceed 1200° C. and even 1400° C.

The turbine components are typically made of temperature resistant nickel or cobalt based "superalloy" materials. These superalloy components are typically further protected by an alumina or MCrAlY basecoat. The basecoat is then typically covered by a ceramic thermal barrier coating ("TBC"), such as stabilized zirconia, for example, 8 wt. % yttria stabilized zirconia ("8YSZ"). The TBC provides low thermal conductivity with low coefficient of thermal expansion mismatch with the basecoat and/or superalloy substrate.

TBCs are typically deposited as a generally columnar grain structure with discrete intercolumnar gaps or cracks that extend generally perpendicular to the top surface of the substrate, as taught for example, in U.S. Pat. No. 4,321,311. This columnar structure is typically formed by plasma assisted physical vapor deposition, electron beam physical vapor deposition, ion beam irradiation, and the like. Alternatively, TBCs are also typically deposited as a generally flat grain structure with discrete cracks or pores that extend generally parallel to the top surface of the substrate, as taught for example, in U.S. Pat. No. 6,294,260. This flat type of coating structure tends to have a poorer erosion resistance but a lower thermal conductivity than columnar structures, and is typically formed by air plasma spraying techniques and the like.

However, currently used air plasma sprayed ("APS") and/or physical vapor deposited ("PVD") YSZ TBCs tend to destabilize after prolonged sustained exposure to temperatures above approximately 1200° C. Such prolonged sustained high temperature exposure can also lead to potential sintering and loss of strain compliance, as well as possible premature TBC failure. YSZ and similar TBCs are also susceptible to corrosion upon exposure to contaminants in the fuel and erosion due to foreign object damage.

U.S. Pat. Nos. 6,294,260 and 6,296,945 to Subramanian disclose certain multiphase TBCs adapted for prolonged exposure to temperatures above approximately 1200° C. and even above approximately 1400° C. These multiphase TBCs comprise the reaction product of a ceramic oxide base layer material having the composition (A,B)xOy and a ceramic oxide overlay precursor material having the composition CzOw. Multiphase TBCs possess a unique set of properties, which the individual constituents may not provide.

However, multiphase TBCs can tend to be relatively difficult to chemically form, manufacture, or arrange onto a basecoat or superalloy substrate, as well as relatively expensive. There is thus a need to continue and improve upon the existing multiphase TBCs adapted for prolonged exposure to temperatures above approximately 1200° C. and even above approximately 1400° C. There is also a need for new and additional multiphase TBCs that tend to be relatively easier to chemically form, manufacture, or arrange onto a basecoat or superalloy substrate, as well as relatively less expensive than that of the prior art.

SUMMARY OF THE INVENTION

The present invention provides new and additional multiphase TBCs that tend to be relatively easier to chemically form, manufacture, or arrange onto a basecoat or superalloy substrate, as well as relatively less expensive than that of the prior art. The present invention also continues and improves upon existing multiphase TBCs adapted for prolonged exposure to temperatures above approximately 1200° C. and even above approximately 1400° C.

One aspect of the present invention thus involves a multiphase ceramic thermal barrier coating adapted for use in high temperature applications for coating superalloy components of a combustion turbine engine. The coating comprises a ceramic single or two oxide base layer disposed on the substrate surface; and a ceramic oxide reaction product material disposed on the base layer, the reaction product comprising the reaction product of the base layer with a ceramic single or two oxide overlay layer.

Another aspect of the invention involves a device adapted for use in a high temperature environment in excess of about 1200° C., comprising a substrate having a surface; a ceramic single oxide base layer disposed on the substrate surface; and a ceramic oxide reaction product material disposed on the base layer, the reaction product comprising the reaction product of the base layer with a ceramic single oxide overlay layer, wherein the single oxide base layer comprises a composition having the formula CzOw and the single oxide overlay layer comprises a composition having the formula AxOy, wherein C and A are selected from the group consisting of: Al, Ca, Mg, Zr, Y, Sc, La, Ce, Pr, Nd, Pm, Sm, Eu, Gd, Dy, Ho, Er, Tm, Yb, Ta, Nb, z and x are selected from the group of integers consisting of: 1, 2, 3, and 4, and w and y are selected from the group of integers consisting of: 1, 2, 3, 4 and 5.

Another aspect of the invention involves a device adapted for use in a high temperature environment in excess of about 1200° C., comprising a substrate having a surface; a ceramic two-oxide base layer disposed on the substrate surface; and a ceramic oxide reaction product material disposed on the base layer, the reaction product comprising the reaction product of the base layer with a ceramic two-oxide overlay layer, wherein the two-oxide base layer comprises a composition having the formula $(C,D)_w,O_z$ and the two-oxide overlay layer comprises a composition having the formula (A,B)xOy, wherein C, D, A and B are selected from the group consisting of: Al, Ca, Mg, Zr, Y, Sc, La, Ce, Pr, Nd, Pm, Sm, Eu, Gd, Dy, Ho, Er, Tm, Yb, Ta, Nb, w and x are decimals ranging from about 0.5 to about 1.5, and z and y are decimals ranging from about 0.5 to about 2.0.

Further aspects, features and advantages of the present invention will become apparent from the drawings and detailed description of the preferred embodiments that follow.

BRIEF DESCRIPTION OF THE DRAWINGS

The above-mentioned and other concepts of the present invention will now be addressed with reference to the drawings of the preferred embodiments of the present invention. The illustrated embodiments are intended to illustrate, but not to limit the invention. The drawings contain the following figures, in which like numbers refer to like parts throughout the description and drawings and wherein.

DETAILED DESCRIPTION OF THE PREFERRED EMBODIMENT

The invention described herein employs several basic concepts. For example, one concept relates to new and additional multiphase TBCs that tend to be relatively easier to chemically form, manufacture, or arrange onto a basecoat or superalloy substrate, as well as relatively less expensive than that of the prior art. Another concept relates to continuing and improving upon existing multiphase TBCs adapted for prolonged exposure to temperatures above approximately 1200° C. and even above approximately 1400° C.

The present invention is disclosed in context of use as a TBC for a superalloy combustion turbine blade. The principles of the present invention, however, are not limited to TBC's for superalloy combustion turbine blades. One skilled in the art may find additional applications for the apparatus, processes, systems, components, configurations, methods, and applications disclosed herein. For example, the TBC can be used with other turbine components such as vanes, transitions, ring segments, buckets, nozzles, combustor cans, heat shields, and the like. For another example, the TBC can be more generally used with any metal or ceramic based substrate or layer where thermal protection is required or helpful, for example, atmospheric reentry vehicles. Thus, the illustration and description of the present invention in context of an exemplary TBC for a superalloy combustion turbine blade is merely one possible application of the present invention. However, the present invention has been found particularly suitable in connection with TBC's for superalloy combustion turbine blades.

Figure 1:
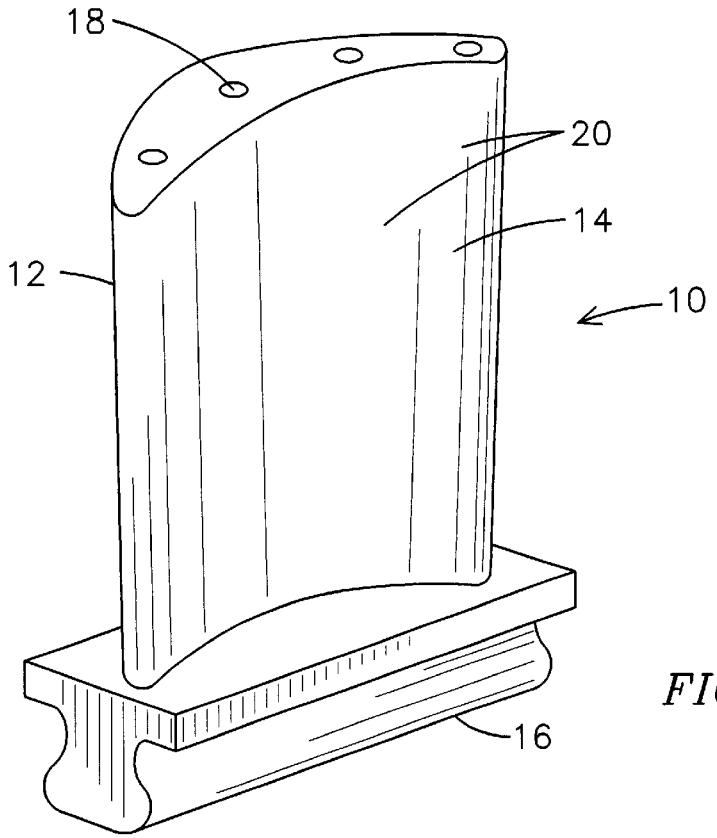
FIG. 1 is a perspective view of a turbine blade having a thermal barrier coating thereon.

Referring now to FIG. 1, an exemplary turbine blade 10 is shown. The blade 10 has a leading edge 12, an airfoil section 14 against which hot combustion gases are directed during turbine operation and which is subject to thermal stresses, oxidation and corrosion, and a root section 16 that anchors the blade 10. Cooling passages 18 may be optionally present through the blade 10 to allow cooling air to transfer heat from the blade 10. The blade 10 advantageously can be made from a high temperature resistant nickel or cobalt based superalloy, for example, one comprising a combination of Ni and Cr.Al.Co.Ta.Mo.W, such as CM247 commercially available from the Cannon Muskegan Corporation located in Muskegan, Mich. A TBC 20 covers at least a portion of the turbine blade 10.

Figure 2:
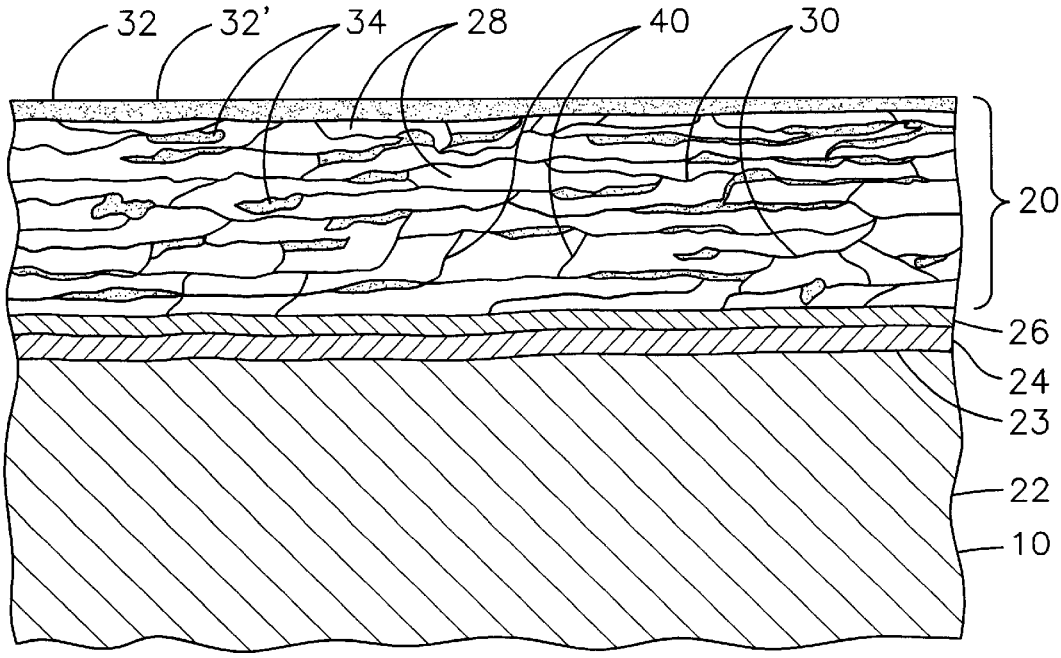
FIG. 2 is a fragmented sectional view through a substrate, such as the turbine blade of FIG. 1, showing a TBC having a discrete parallel-grain structure and microcracks, and a top reaction product after heat treatment.
Figure 3:
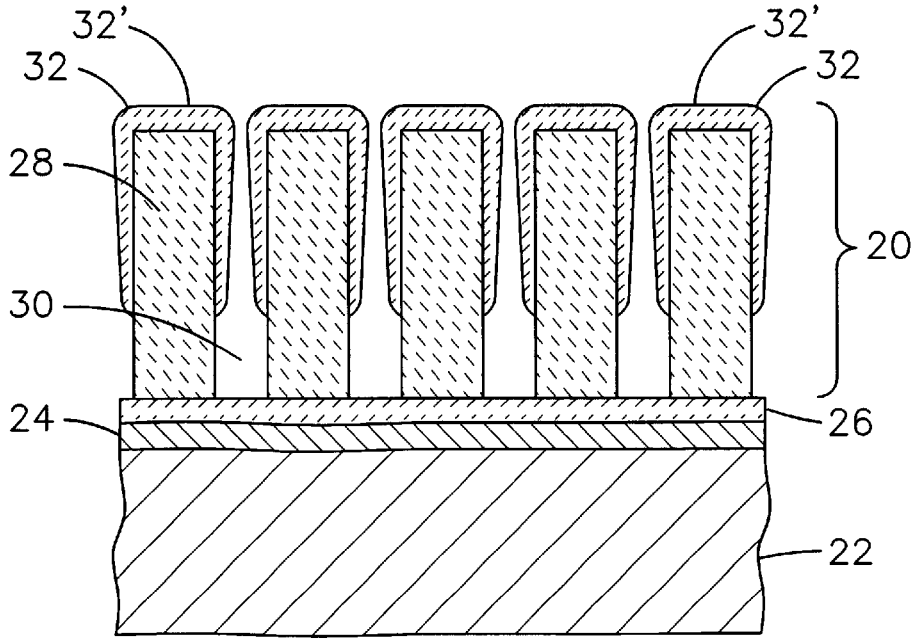
FIG. 3 is a fragmented sectional view through a substrate, such as the turbine blade of FIG. 1, showing a TBC having a discrete columnar-grain structure and intercolumnar gaps, and a top reaction product after heat treatment with a continuous sheath coating.
Figure 4:
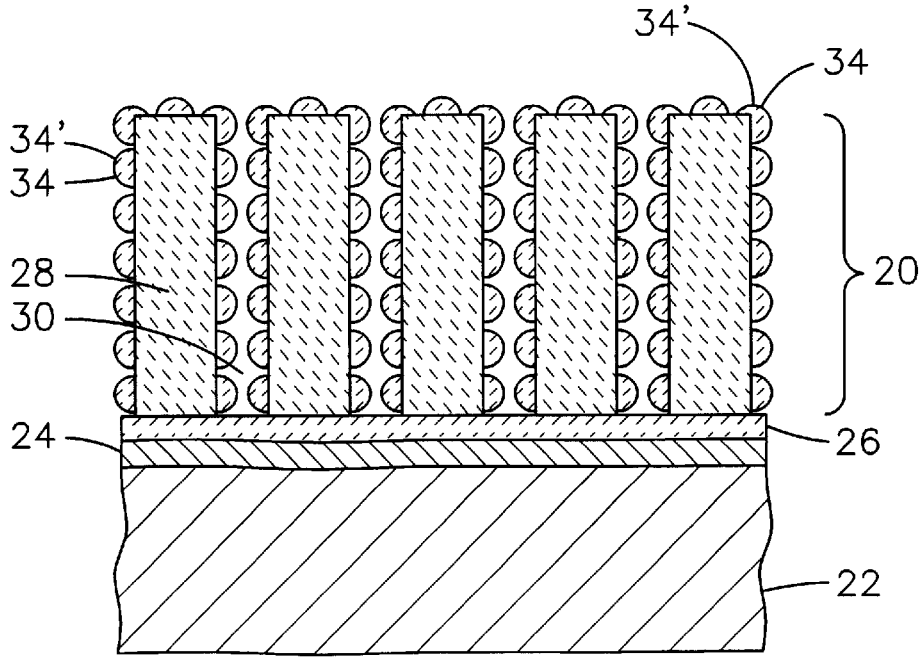
FIG. 4 is a fragmented sectional view similar to FIG. 3, showing the top reaction product with a discontinuous sheath coating forming a plurality of nodules.

Referring now to FIGS. 2, 3 and 4, the TBC 20 advantageously comprises a base layer 28 and one or more overlays 32 that form a reaction product 32' upon heat treatment. One or more optional bond layers 24, 26 can be arranged between the TBC 20 and turbine blade 10.

If used, the optional bond layer 24 forms the first layer on the turbine blade 10 (more generally, the substrate 10). The bond layer 24 typically comprises either alumina or MCrAlY, where M is a metal selected from the group consisting of Co, Ni and mixtures or combinations thereof, and Y is selected from the group consisting of Y, La, Hf. Also, Pt and/or Re can be incorporated into the bond layer 24 composition. The bond layer 24 can be applied by sputtering, electron beam vapor deposition, low pressure plasma spraying and the like, to provide a dense relatively uniform layer of about 0.02 mm to about 0.3 mm thick. This bond layer 24 can be subsequently polished to provide a smooth finished layer. One purpose of the bond layer 24 is to allow an oxide scale 26 predominately comprising alumina to form in order to further protect the blade 10 from oxidative attack. The bond coat 24 also provides a good bonding surface for the TBC 20. Various combinations of one or more underlayers 24, 26 can be used, or the TBC can be applied directly onto the substrate blade 10.

Still referring to FIGS. 2, 3 and 4, the base layer 28 is deposited onto either the bond layer 24 (as shown) or directly onto the substrate 10 (not shown) via an APS or PVD process described below.

The base layer 28 can be a single-oxide having the chemical formula denoted by AxOy, where A is selected from the group consisting of: Al, Ca, Mg, Zr, Y, Sc, La, Ce, Pr, Nd, Pm, Sm, Eu, Gd, Dy, Ho, E, T, Yb, Ta, Nb combinations thereof and the like. Since only a single-oxide is used, variable x can be the integers 1, 2 and 3, and variable y can be the integers 1, 2, 3, 4, and 5. A preferred single oxide base material 28 is yttria ($Y_2O_3$).

Alternatively, the base layer 28 can be a mixture of two oxides having the chemical formula denoted by $A_{x1}O_{y1}$ and $B_{x11}O_{y11}$ or more simply (A,B)xOy, where A and B are selected from the group consisting of: Al, Ca, Mg, Zr, Y, Sc, La, Ce, Pr, Nd, Pm, Sm, Eu, Gd, Dy, Ho, Er, Tm, Yb, Ta, Nb combinations thereof and the like. A preferred two-oxide base material 28 is yttria ($Y_2O_3$) and zirconia ($ZrO_2$), with the yttria content ranging from 10 wt. % to 60 wt. % of the overall base material 28.

The following basic mathematical calculations are helpful in arranging the base layer 28 two oxides $A_{x1}O_{y1}$ and $B_{x11}O_{y11}$ into simplified $(A,B)_xO_y$ form: (1) calculate the weight of each element within the base material, (2) arrange the weights into chemical equation form, and (3) mathematically normalize the chemical equation into Applicant's $(A,B)_xO_y$ form. For example, using the preferred base material oxides of yttria ($Y_2O_3$) and zirconia ($ZrO_2$) with a yttria content of 10 wt. %, i.e. 10% $Y_2O_3$ and 90% $ZrO_2$, variables x and y are easily calculated as follows:

(1) Calculate the weight of each element within the exemplary base material:

weight of Y=amount of Y*weight of $Y_2O_3$=2*(10%/225.81)=0.09 weight of Zr=amount of Zr*weight of $ZrO_2$=1*(90%/123.0.73)=0.73 weight of O=amount of O*wt of $Y_2O_3$+amount of O*wt of $ZrO_2$=3*(10%/225.81)+2*(90%/123.0.73)=1.59

(2) Arrange these mathematically calculated weights into chemical equation form:

$Y_{0.09}Zr_{0.73}O_{1.79}$ (3) Mathematically normalize this chemical equation into the simplified (A,B)xOy format of (where Y+Zr=1):

$Y_{0.09/(0.09+0.73)}Zr_{0.73/(0.09+0.73)}O_{1.79}=(Y_{0.11}Zr_{0.89})_{0.82}O_{1.79}$

As can be appreciated, since the two oxides have a relative weight percentage range, if the foregoing basic mathematical calculations are performed with $Y_2O_3$ and $ZrO_2$ oxides having different relative weight percentages between the 10%–60% values, then variables x and y will accordingly change. Moreover, if different A and B oxides are used, then variable x and y will further change. The listing below illustrates exemplary x and y variance. Without performing the forgoing basic mathematical calculations for each possible chemical combination, variable x tends to range from about 0.4 to about 2.0, and variable y tends to range from about 0.8 to about 2.9.

| A oxide = Y ($Y_2O_3$) weight % of $Y_2O_3$ | B oxide = Zr ($ZrO_2$) equation $(A,B)_xO_y$ |
|---|---|
| 10 | $(Y_{0.11}Zr_{0.89})_{0.82}O_{1.59}$ |
| 20 | $(Y_{0.21}Zr_{0.79})_{0.83}O_{1.56}$ |
| 30 | $(Y_{0.32}Zr_{0.68})_{0.83}O_{1.53}$ |
| 40 | $(Y_{0.42}Zr_{0.58})_{0.84}O_{1.51}$ |
| 50 | $(Y_{0.52}Zr_{0.48})_{0.85}O_{1.48}$ |
| 60 | $(Y_{0.62}Zr_{0.38})_{0.86}O_{1.45}$ |

The overlay layer 32 is deposited as a precursor coating on top of the underlying base layer 28 via a process that allows for topside deposition and infiltration in between the PVD deposited gaps or cracks, or the APS deposited cracks or pores. Suitable deposition techniques include electron beam evaporation, air plasma spray, chemical vapor deposition, sol-gel, combinations thereof and the like.

Like with the base layer 28, the overlay layer 32 can be a single-oxide having the chemical formula denoted by CwOz, where C is selected from the group consisting of: Al, Ca, Mg, Zr, Y, Sc, La, Ce, Pr, Nd, Pm, Sm, Eu, Gd, Dy, Ho, E, T, Yb, Ta, Nb combinations thereof and the like. Since only a single oxide is used, variable w can be the integers 1, 2 and 3, and variable z can be the integers 1, 2, 3, 4 and 5. A preferred single oxide overlay layer 32 is alumina ($Al_2O_3$). It is also preferred that composition C not be the same as compositions A or B, since use of similar compositions tends not to yield desired reaction products.

Alternatively, the overlay precursor layer 28 can be a mixture of two oxides having the chemical formula denoted by $C_{w1}O_{z1}$ and $D_{w11}O_{z11}$ or more simply (C,D)wOz, where C and D are selected from the group consisting of: Al, Ca, Mg, Zr, Y, Sc, La, Ce, Pr, Nd, Pm, Sm, Eu, Gd, Dy, Ho, Er, Tm, Yb, Ta, Nb combinations thereof and the like. Since the two oxides have a relative weight percentage range, variables w and z are not restricted to integer values and may be decimals as easily understood and calculable by those skilled in the art, with w being a decimal ranging from about 0.5 to about 1.5 and z being a decimal ranging from about 0.5 to about 2.0. A preferred two-oxide overlay layer 32 is where C=Gd and D=Al, with the (C,D)Oz content ranging from about 10 wt. % to about 50 wt. % of the overall overlay layer 32. It is also preferred that compositions C and D not be the same as compositions A or B, since use of similar compositions tends not to yield desired reaction products, for example, $Cw_1Oz_1=Gd_2O_3$ and $Dw_{11}O2_{11}=Al_2O_3$ has been found suitable.

The base layer 28 and the overlay layer 32 are allowed to chemically react by heating the reactants 28, 32 to about 1200–1500° C. or other suitable means in order to induce the reaction. Overlay layer 32 is thereby transformed into a new overlay phase/material 32' formed on the top surface of the TBC 20. The exact composition of the final reaction product 32' may vary, dependent on the phase stability of the two reactants 28, 32 and the final reaction product desired at the surface temperature during service. The reaction product 32' should be in thermodynamic equilibrium with the overall TBC 20 and should not completely dissolve into the TBC 20 upon long term service even at high temperatures, which ensures the stability of the multiphase TBC 20. The thickness of the final reaction product 32' can vary between about 0.0002 micrometers (2 Angstrom units) to about 10 micrometers.

Some illustrative examples of the above-described reactions are provided:

single-oxide base layer+single-oxide overlay layer→reaction product $(Y_{0.11}Zr_{0.89})_{0.82}O_{1.59}+0.00683Ta_2O_5\rightarrow 0.0136Y_3TaO_7+(Y_{0.06}Zr_{0.89})_{0.82}O_{1.528}$ single-oxide base layer+two-oxide overlay layer→reaction product $0.23Al_2O_3+(Y_{0.62}Zr_{0.38})_{0.86}O_{1.45}\rightarrow 0.092Y_3Al_5O_{12}+(Y_{0.29}Zr_{0.38})_{0.86}O_{1.036}$ two-oxide base layer+single-oxide overlay layer→reaction product CaO stabilized $ZrO_2$: $(Ca_{0.38}Zr_{0.62})_1O_{1.62}+0.1TiO_2\rightarrow 0.1CaTiO_3+0.94(Ca_{0.32}Zr_{0.68})_{1.06}O_{1.62}$ MgO stabilized $ZrO_2$: $(Mg_{0.46}Zr_{0.54})_1O_{1.54}+0.1TiO_2\rightarrow 0.1MgTiO_3+0.94(Mg_{0.46}Zr_{0.54})_{1.07}O_{1.54}$ MgO stabilized $ZrO_2$: $(Mg_{0.46}Zr_{054})_1O_{1.54}+0.1Al_2O_3\rightarrow .01MgAl_2O_4+0.935(Mg_{0.4}Zr_{0.6})_{0.9625}O_{1.54}$ $Y_2O_3$ stabilized $ZrO_2$: $(Y_{0.32}Zr_{0.68})_{1.19}O_{2.19}+0.1Al_2O_3\rightarrow 0.04Y_3Al_5O_{12}+0.92(Y_{0.2422}Zr_{0.7578})_{1.16}O_{2.19}$ $Yb_2O_3$ stabilized $ZrO_2$: $(Yb_{0.21}Zr_{0.79})_{1.12}O_{2.12}+0.1Al_2O_3\rightarrow 0.04Yb_3Al_5O_{12}+0.92(Yb_{0.1166}Zr_{0.8834})_{1.09}O_{2.12}$ $Y_2O_3$ stabilized $HfO_2$: $(Y_{0.39}Hf_{0.61})_{1.24}O_{2.24}+0.1Al_2O_3\rightarrow 0.04Y_3Al_5O_{12}+0.91(Y_{0.3288}Hf_{0.6712})_{1.24}O_{2.24}$ $Yb_2O_3$ stabilized $HfO_2$: $(Yb_{0.27}Hf_{0.73})_{1.16}O_2+0.1Al_2O_3\rightarrow 0.04Yb_3Al_5O_{12}+0.91(Yb_{0.1866}Hf_{0.8134})_{1.13}O_{2.16}$ $Y_2O_3$ stabilized $TiO_2$: $(Y_{0.23}Ti_{0.77})_{1.13}O_{2.13}+0.1Al_2O_3\rightarrow 0.1Al_2TiO_5+0.93(Y_{0.252}Ti_{0.747})_{1.11}O_{2.13}$ $Yb_2O_3$ stabilized $TiO_2$: $(Yb_{0.15}Ti_{0.85})_{1.08}O_{2.08}+0.1Al_2O_3\rightarrow 0.1Al_2TiO_5+0.90(Yb_{0.165}Ti_{0.835})_{1.08}O_{2.08}$ $(Y_{0.18}Al_{0.82})_2O_{2.18}+0.1Al_2O_3\rightarrow 0.9571(Y_{0.18}Al_{0.82})_2O_{2.18}+0.0571Y_3Al_5O_{12}$

[$(Y_{0.18}Al_{0.82})_2O_{2.18}$ corresponds to the compound $Y_4Al_2O_9$]

two-oxide base layer+two-oxide overlay layer→reaction product $$(Y_{0.11}Zr_{0.89})_{0.82}O_{1.59}+(Gd_{0.5}Al_{0.5})_2O_3\rightarrow(Y_{0.051}GdZr_{0.89})_{0.82}O_{1.59}+Y_{0.005}AlO_3$$

Multiphase TBCs 20 possess a unique set of properties, which the individual constituents may not provide. The multiphase TBC 20 comprises materials, compositions and/or phases that have formed as a result of a reaction between two or more materials or compositions 28, 32 that have been deposited onto the substrate 10. The materials or compositions 28, 32 are advantageously selected based on their phase stability and possible reaction products. The reaction products 32' that subsequently form part of the TBC 20 are selected such that they are phase stable to high temperatures, possess low thermal conductivity and have a low tendency to sinter. In addition, the reaction product 32' can be selected to provide improved corrosion and erosion resistance.

The multiphase TBC 20 can be applied by any one or more methods that provide good adherence in a thickness effective to provide the required thermal protection for the substrate 10, preferably APS or PVD, and usually in the order of about 50 micrometers to about 350 micrometers.

For example, an APS method can be used to deposit the base layer 28 to provide a microstructure well known by those skilled in the art. Such a microstructure is characterized by a generally flat, planar or horizontal grain structure 40 with discrete microfissures or intersplat cracks 30 and pores or volumes 34 that extend generally parallel to the top surface of the substrate 10 (FIG. 2). In other words, the base layer 28 microstructure consists of solidified splats of the molten ceramic 28 that have microfissures 30 and volumes 34 formed during the deposition process and arranged within and/or between the splats. The strain tolerance of the TBC 20 results due to these microfissures 30 and volumes 34 within the splats.

For another example, a PVD method can be used to deposit the base layer 28 to provide another microstructure well known by those skilled in the art. Such a microstructure is characterized by a generally columnar or vertical grain structure 40 with discrete microcracks, volumes or gaps 30 that extend generally perpendicular to the top surface of the substrate 10 (FIGS. 3 and 4). The reaction product 32' can form a continuous coating over the entire column 40 FIG. 3), a discontinuous nodules 34" (FIG. 4), or other morphologies such as rivulets, grains, cracks, flakes, combinations thereof and the like (not shown). Non continuous coating morphologies can enhance the break up of intermitted bridges and the like that can form between the adjacent columns 40 or gaps 18, 30 upon regular thermal cycling, thus maintaining and improving the strain tolerance of the TBC.

An APS, PVD or other method could then be used to apply the overlay layer 32 on top of the base layer 28. The applied overlay layer 32 material can thereby infiltrate into the cracks, gaps, and volumes 30, 34 by gravity, absorption, adsorption, capillary action and the like. After suitable infiltration, the base layer 28 and overlay layer 32 can be reacted to form the reaction product 32' and multiphase TBC 20.

Generally, the temperature of the TBC 20 decreases across the thickness of the TBC 20 from the top outside surface to the substrate 10. Also, if the multiphase TBC is required only where the temperatures are highest, then the infiltration depth of the overlay layer 32 should be more closely controlled. Modification of the deposition parameters can control the depth of infiltration of the overlay layer 32 into the base layer 28, and consequently the depth of the reaction product 32' across the thickness of the TBC 20. The depth of the infiltration also depends on the variation of the volumes 30, 34 from the exposed TBC surface to the TBC/substrate interface. The thickness of the underlying base layer 32 and the overlay layer 28 can be modified to obtain a specific thickness and volume of the reaction product 32'. The total thickness of the final multiphase TBC system 20 should range in the order of about 50 micrometers to about 350 micrometers.

Although such a multiphase TBC system should possess a high thermal expansion, the reaction products 32' need not have a high thermal expansion. The thermal expansion mismatch between the reaction product 32' and the underlying TBC 20 can be allowed to be sufficiently high, however, to introduce cracks in the reaction product 32' due to coefficient of thermal expansion mismatch stress. This can be beneficial in breaking up any bonds that may have formed during sintering.

An example of a processing method of the invention involves subjecting a standard Ni-based superalloy turbine component substrate 10 having a MCrAlY bond coat 24 and an alumina formed overlayer 26 to standard ceramic YSZ deposition by APS or PVD. The YSZ thereby forms the base layer 28 having microcracks 30 and/or pores 34. An alumina overcoat layer 32 is then deposited over the base layer 28 via a vapor deposition technique and allowed to infiltrate into the base layer 28. The coated substrate 10, 28, 32 is then heated to initiate a reaction between the $Al_2O_3$ overlay layer 32 and the infiltrated YSZ base layer 32 to form a reaction product material 32' containing major amounts of $Y_3Al_5O_{12}$, a yttrium aluminum garnet (YAG) as the finalized overcoat material 32', with the underlying base layer 28 as yttrium stabilized zirconia.

This exemplary YAG multiphase TBC 10 has a unique combination of low thermal conductivity, high thermal expansion, long term phase stability and good strain compliance. The high thermal expansion, low thermal conductivity and long term phase stability could be provided by the YSZ base layer 28. For example, 10–60YSZ is phase stable as a cubic crystal structure upon long term exposure and also has low thermal conductivity of 1–2 W/mK (Watt/meter °Kelvin). The presence of $Y_2O_3$ in the stabilized zirconia would aid in the sintering of the TBC, but due to its presence the strain compliance of the coating could be expected to be somewhat compromised. This could be is alleviated by the formation of the YAG reaction product 32'. YAG has a low thermal conductivity—lower than 2–3 W/mK at temperatures higher than 1000° C. In addition, even at about 1400° C., the reaction product does not show a tendency to sinter. Since the reaction product 32' can also be formed between the cracks 30 and/or volumes 34, the coating should also be strain compliant. Also, the reaction product 32' is in thermodynamic equilibrium with the overall TBC 10, which helps ensure the presence of the reaction product 32' over the long term service of the component 10. Thus, this exemplary multiphase TBC 10 can be used at very high temperatures for long term exposure while the reaction product 32' functions as at least one of a sintering inhibitor, a corrosion resistant coating, an erosion resistant coating, and a low thermal conductivity coating.

Although this invention has been described in terms of certain exemplary uses, preferred embodiments, and possible modifications thereto, other uses, embodiments and possible modifications apparent to those of ordinary skill in the art are also within the spirit and scope of this invention. It is also understood that various aspects of one or more features of this invention can be used or interchanged with various aspects of one or more other features of this invention. Accordingly, the scope of the invention is intended to be defined only by the claims that follow.

What is claimed is:

1. A device adapted for use in a high temperature environment in excess of about 1200° C., comprising:

a substrate having a surface;

a ceramic single oxide base layer disposed on the substrate surface; and a ceramic oxide reaction product material disposed on the base layer, the reaction product comprising the reaction product of the base layer with a ceramic single oxide overlay layer, wherein the single oxide base layer comprises a composition having the formula CzOw and the single oxide overlay layer comprises a composition having the formula AxOy, wherein C and A are selected from the group consisting of: Al, Ca, Mg, Zr, Y, Sc, La, Ce, Pr, Nd, Pm, Sm, Eu, Gd, Dy, Ho, Er, Tm, Yb, Ta, Nb, z and x are selected from the group of integers consisting of: 1, 2, 3, and 4, and w and y are selected from the group of integers consisting of: 1, 2, 3, 4 and 5.

2. The device of claim 1, wherein the base layer is disposed on the substrate surface as columnar grain structure with discrete intercolumnar gaps or cracks that extend generally perpendicular to a top surface of the substrate.

3. The device of claim 2, wherein the base layer is disposed by a physical vapor deposition technique.

4. The device of claim 1, wherein the base layer is disposed on the substrate surface with a flat grain structure with discrete cracks or pores that extend generally parallel to the top surface of the substrate.

5. The device of claim 4, wherein the base layer is disposed by an air plasma spray technique.

6. The device of claim 1, wherein the substrate is a component of a combustion turbine engine.

7. The device of claim 6, wherein the component is selected from the group consisting of: blade, vane, transition, ring segment, bucket, nozzle, combustor can, and heat shield.

8. A device adapted for use in a high temperature environment in excess of about 1200° C., comprising:

a substrate having a surface;

a ceramic two-oxide base layer disposed on the substrate surface; and a ceramic oxide reaction product material disposed on the base layer, the reaction product comprising the reaction product of the base layer with a ceramic two-oxide overlay layer, wherein the two-oxide base layer comprises a composition having the formula $(C,D)_wO_z$ and the two-oxide overlay layer comprises a composition having the formula (A,B)xOy, wherein C, D, A and B are selected from the group consisting of: Al, Ca, Mg, Zr, Y, Sc, La, Ce, Pr, Nd, Pm, Sm, Eu, Gd, Dy, Ho, Er, Tm, Yb, Ta, Nb, w and x are decimals ranging from about 0.5 to about 1.5, and z and y are decimals ranging from about 0.5 to about 2.0.

9. The device of claim 8, wherein the base layer is disposed on the substrate surface as columnar grain structure with discrete intercolumnar gaps or cracks that extend generally perpendicular to a top surface of the substrate.

10. The device of claim 9, wherein the base layer is disposed by a physical vapor deposition technique.

11. The device of claim 8, wherein the base layer is disposed on the substrate surface with a flat grain structure with discrete cracks or pores that extend generally parallel to the top surface of the substrate.

12. The device of claim 11, wherein the base layer is disposed by an air plasma spray technique.

13. The device of claim 8, wherein the substrate is a component of a combustion turbine engine.

14. The device of claim 13, wherein the component is selected from the group consisting of: blade, vane, transition, ring segment, bucket, nozzle, combustor can, and heat shield.

* * * * *